US005389483A

United States Patent [19]

Kawasaki et al.

[11] Patent Number: 5,389,483

[45] Date of Patent: Feb. 14, 1995

[54] ELECTROPHOTOGRAPHIC TONER HAVING TWO ETHYLENE POLYMERS

[75] Inventors: Shoji Kawasaki, Yokohama; Nobuhiro Hirayama, Hiratsuka; Kenji Uchiyama, Odawara; Hisatomo Sato, Yokohama; Hiromi Akiyama, Hiratsuka, all of Japan

[73] Assignee: Mitsui Toatsu Chemicals, Incorporated, Tokyo, Japan

[21] Appl. No.: 74,158

[22] Filed: Jun. 9, 1993

Related U.S. Application Data

[63] Continuation of Ser. No. 743,371, Aug. 26, 1991, abandoned.

[30] Foreign Application Priority Data

Dec. 26, 1989 [JP] Japan ..... 1-334822

[51] Int. Cl.[6] ..... G03G 9/087

[52] U.S. Cl. ..... 430/109; 430/110; 430/137

[58] Field of Search ..... 430/904, 109, 114, 137

[56] References Cited

U.S. PATENT DOCUMENTS 4,246,332 1/1981 Tanaka et al. ..... 430/109
4,499,168 2/1985 Mitsuhashi ..... 430/99
4,963,456 10/1990 Shin et al. ..... 430/109
4,968,574 11/1990 Morita et al. ..... 430/109
5,084,368 1/1992 Hirayama et al. ..... 430/109
5,098,811 3/1992 Anno et al. ..... 430/110

FOREIGN PATENT DOCUMENTS 56-16144 2/1981 Japan .
2078385 1/1982 United Kingdom .

*Primary Examiner*—Roland Martin
*Attorney, Agent, or Firm*—Oblon, Spivak, McClelland, Maier & Neustadt

[57] ABSTRACT

The present invention provides electrophotographic toner which comprises as a principal component a mixture of 20–80 parts by weight of a first ethylene polymer (X) whose weight-average molecular weight (Mw) is at least 200,000 and a second ethylene polymer (Y) whose Z average molecular weight/number-average molecular weight (Mz/Mn) is at least 6 and Mw is not greater than 50,000. According to this invention, electrophotographic toner of wide non-offset range can be obtained and, images of stable quality in a low heat quantity, which have not been attained by the prior art, can be obtained.

12 Claims, No Drawings

ELECTROPHOTOGRAPHIC TONER HAVING TWO ETHYLENE POLYMERS

This application is a continuation of application Ser. No. 07/743,371, filed on Aug. 26, 1991, now abandoned.

TECHNICAL FIELD

This invention relates to electrophotographic toner capable of fixing at low heat and having excellent image quality.

BACKGROUND ART

In the field of electrophotography, the copying speed required has tended to increase to meet the ever increasing quantity of information. In a high-speed copying machine, the heat transmitted from a fixing hot roll is low compared with a medium-speed copying machine; as well, the surface temperature of the fixing hot roll falls appreciably because more heat absorbed by the paper than can be fully compensated for. Accordingly, there is a demand for a toner composition which can be fixed at low heat and does not cause an offset problem at this lower level of fixing temperature.

On the other hand, copying machines have become smaller, and the pressure and temperature of a fixing roll have lowered. In this field, the development and improvement of developers with good fixing properties and offset resistance even at low heat have also been conducted.

For example, there is known a process disclosed in Japanese Patent Publication No. 6895/1980 which provides a toner having good offset resistance using, as a resin for the developer, a resin having a weight-average molecular weight/number-average molecular weight ratio of 3.5–40 and a number-average molecular weight of 2,000–30,000; and also a process disclosed in Japanese Patent Application Laid-Open No. 101031/1974 which widens the range of fixing temperature and provides a toner free from offset problems even at a comparatively high fixing temperature by using a crosslinked resin.

It has been found, however, that whereas the prior art as described above is effective for the conventional copying machine troubled with an offset problem, a sufficient effect cannot be obtained in the case of a copying machine which uses a lower heat for fixing. This is presumed to result from the improvements that have been made in order to increase the weight-average molecular weight of the resin to achieve an improvement in the strength and offset resistance of the toner.

Accordingly, the resins described above have such a high viscosity that they are not suitable in their conventional form for the lower-heat fixing copying machines. Viscosity reduction of the resin by lowering its weight-average molecular weight, however, tends to damage the offset resistance or the strength of the toner. As the result of a long-term operation, breakage of the toner occurs, which tends to deteriorate the picture quality.

DISCLOSURE OF THE INVENTION

An object of the present invention is to solve all the problems of the prior art and to provide a toner, which is capable of fixing at lower-heat levels and is excellent in strength, suitable for a recently-developed high-speed copying machine or lower-heat copying machine.

The present inventors have found that shortage in the strength of the toner on the whole was caused by the low strength of the low-molecular resin having high flowability in the toner. In addition, they have found that the problems described above can be dissolved by producing toner using an ethylene polymer having a weight-average molecular weight (Mw) of at least 200,000 and another ethylene polymer having both of high resin strength and high flowability Namely, the present invention provides an electrophotographic toner composition comprising as a principal component a mixture of (X) 20–80 parts by weight of a first ethylene polymer having a weight-average molecular weight (Mw) of at least 200,000 [hereinafter called a first ethylene polymer (X)] and (Y) 80–20 parts by weight of a second ethylene polymer having a Z average molecular weight/number-average molecular weight (Mz/Mn) ratio of at least 6 and Mw of not greater than 50,000 [hereinafter called a second ethylene polymer (Y)].

In accordance with the process of the present invention described above, an electrophotographic toner composition which always produces stable and good-quality pictures when fixed at lower heat levels is provided, which has not been actualized by the prior art. The resultant benefits of the present invention are that the lowest limit of the fixing temperature is low, non-offset range is wide and picture properties are remarkably good. It has, thus, excellent properties as an electrophotographic toner composition.

BEST MODE FOR CARRYING OUT THE INVENTION

A first ethylene polymer (X) in the present invention has a molecular weight Mw of at least 200,000, with 200,000–1,000,000 being particularly preferred. Mw of the first ethylene polymer (X) has a significant influence on the offset resistance of the toner, frictional resistance in the test of fixing property, image stability and the like. If the polymer has a molecular weight smaller than 200,000, the above properties of the toner are appreciably deteriorated.

The proportion of the first ethylene polymer (X) in the present invention is necessarily 20–80 parts by weight, with 30–70 parts by weight being particularly preferred. Proportions of the first ethylene polymer (X) smaller than 20 parts by weight lead to a decrease in the strength and viscosity of the resin, which in turn results in the deterioration of its offset resistance, frictional resistance at the time of fixing and image stability. Proportions greater than 80 parts by weight, on the other hand, lead to an increase in the viscosity of the resin, whereby the sufficient fixing can not be obtained at lower heat levels. Proportions outside the above range are therefore not preferred.

It is preferable that the second ethylene polymer (Y) of the present invention has the Z average molecular weight/number-average molecular weight (Mz/Mn) ratio of at least 6 and Mw of not greater than 50,000. If the Mz/Mn ratio is smaller than 6, the resin strength of the second ethylene polymer (Y) cannot be guaranteed and therefore, stable copied images can not be provided. If Mw is greater than 50,000, on the other hand, the flowability of the resin becomes worse though the resin strength is guaranteed and as a result, fixing at lower heat levels cannot be conducted. Preferably, the Mz/Mn ratio is 6–100 and Mw is 1,000–50,000.

The second ethylene polymer (Y) usable in the present invention, which has a Z average molecular weight-/number-average molecular weight (Mz/Mn) ratio of at least 6 and Mw of not greater than 50,000, can be produced by various methods as follows: (1) a method to obtain a polymer having wide molecular-weight distribution by continuously or intermittently changing the polymerization temperature or the like, (2) a method in which at least two high molecules are mixed to an extent that Mw does not exceed 50,000, (3) a method to widen the molecular- weight distribution using a cross-linking agent.

First and second ethylene polymers (X) and (Y) in the present invention are each obtained by polymerizing an ethylenically-unsaturated monomer according to the polymerization method such as solution polymerization, suspension polymerization and emulsion polymerization.

Examples of the ethylenically-unsaturated monomer described above include acrylic acid esters such as methyl acrylate, ethyl acrylate, propyl acrylate, butyl acrylate, octyl acrylate, cyclohexyl acrylate, lauryl acrylate, stearyl acrylate, benzyl acrylate, furfuryl acrylate, tetrahydrofurfuryl acrylate, hydroxyethyl acrylate, hydroxybutyl acrylate, dimethylaminomethyl acrylate ester, and dimethylaminoethyl acrylate ester; methacrylic acid esters such as methyl methacrylate, ethyl methacrylate, propyl methacrylate, butyl methacrylate, octyl methacrylate, lauryl methacrylate, stearyl methacrylate, cyclohexyl methacrylate, benzyl methacrylate, furfuryl methacrylate, tetrahydrofurfuryl methacrylate, hydroxyethyl methacrylate, hydroxypropyl methacrylate, hydroxybutyl methacrylate, dimethylaminomethyl methacrylate ester, and dimethylaminoethyl methacrylate ester; aromatic vinyl monomers such as vinyltoluene, α-methylstyrene, chlorostyrenes, and styrene; dialkyl esters of unsaturated dibasic acids such as dibutyl maleate, dioctyl maleate, dibutyl fumarate, and dioctyl fumarate; vinyl esters such as vinyl acetate and vinyl propionate; nitrogen-containing vinyl monomers such as acrylonitrile and methacrylonitrile; unsaturated carboxylic acids such as acrylic acid, methacrylic acid and cinnamic acid; unsaturated dicarboxylic acids such as maleic acid, maleic anhydride, fumaric acid, and itaconic acid; monoester of unsaturated dicarboxylic acids such as monomethyl maleate, monoethyl maleate, monobutyl maleate, monooctyl maleate, monomethyl fumarate, monoethyl fumarate, monobutyl fumarate and monooctyl fumarate; styrenesulfonic acid; acrylamide; methacrylamide; N-substituted acrylamide; N-substituted methacrylamide; and methacrylamidopropanesulfonic acid. At least one monomer is selected from the monomers illustrated above. Among these, acrylic acid esters, methacrylic acid esters, styrene, dialkyl fumarate esters, acrylonitrile, methacrylic acid, cinnamic acid, monoesters of fumaric acid, acrylic acid, acrylamide, methacrylamide and the like are particularly preferred.

The proportion of the above polymer mixture in the toner is generally 50–95 wt.%. In addition, the polymer mixture may be added, if needed, with polyvinyl chloride, polyolefins, polyesters, polyvinyl butyral, polyurethanes, polyamides, rosin, terpene resins, phenol resins, epoxy resins, paraffin wax and polyolefin wax to an extent not impairing the effects of the present invention.

To the electrophotographic toner of the present invention, a colorant is added ordinarily. Examples of the colorant include black pigments such as carbon black, acetylene black, lamp black, and magnetite; and pigments known to date such as chrome yellow, yellow iron oxide, Hansa yellow G, quinoline yellow lake, Permanent Yellow, NCG molybdenum orange, Vulcan orange, Indanthrenes, Brilliant Orange GK, red iron oxide, Brilliant Carmine 6B, flizarin lake, methyl violet lake, Fast Violet B, cobalt blue, alkali blue lake, phthalocyanine blue, Fast Sky Blue, Pigment Green B, malachite green lake, titanium oxide and zinc white. The colorant is generally added in an amount of 5–300 parts by weight per 100 parts by weight of the polymer.

The toner composition according to the present invention may be selectively added, for example, with a known charge control agent such as nigrosin, a tertiary ammonium salt, a metal-containing azo dye and a metallic salt of an aliphatic acid; a pigment dispersant; an offset inhibitor; and the like and may then be converted into a toner by a method known per se in the art.

Namely, the resultant polymer mixture with the above various additives incorporated therein is premixed in a Henschel, kneaded in a heated and melted state in a kneader, cooled, comminuted finely by means of a jet pulverizer, and then classified by a classifier to collect particles, generally, in a range of 8–20 μm as a toner.

The present invention will hereinafter be described specifically by the following examples. It should however be borne in mind that this invention is by no means limited to or by the examples, in which all designations of "part" or "parts" mean part or parts by weight unless otherwise specifically indicated.

Production Example 1

To a 4-necked 5 l flask, a condenser, a thermometer, a nitrogen inlet tube and a stirrer were attached. In this flask, 70 parts of styrene and 30 parts of n-butyl acrylate were charged. They were heated to 100° C. while introducing nitrogen. Then, the reaction mixture was continuously added dropwise with 100 parts of xylol and 0.2 part of azoisobutyronitrile over 10 hours. After that, the polymerization of residual monomers was conducted over 5 hours at the temperature heated to 130° C. The resin solution thus obtained was subjected to solvent removal, whereby Resin A was obtained.

Production Example 2

Resin B was obtained as in Production Example 1 except that the amount of azoisobutyronitrile was increased to 0.4 part.

Production Example 3

Resin C was obtained as in Production Example 1 except that the amount of azoisobutyronitrile was increased to 0.6 part.

Production Example 4

Resin D was obtained as in Production Example 1 except that the amount of azoisobutyronitrile was increased to 1.0 part.

Production Example 5

To a 4-necked 5 l flask, a cooling tube, a thermometer, a nitrogen inlet tube and a stirrer were attached. In this flask, 100 parts of xylol were charged. They were heated to under reflux while introducing nitrogen. Then, 85 parts of styrene, 15 parts of n-butylacrylate, 5 parts of azoisobutyronitrile and 0.1 part of divinylbenzene were continuously added dropwise over 5 hours. After that, the polymerization of residual monomers was conducted over further 10 hours. The resin solution thus obtained was subjected to solvent removal, whereby Resin E was obtained.

Production Example 6

Resin F was obtained as in Production Example 5 except that the amount of divinylbenzene was increased to 0.5 part.

Production Example 7

Resin G was obtained as in Production Example 5 except that the amount of divinylbenzene was changed to 1.0 part.

Production Example 8

Resin H was obtained as in Production Example 5 except that the amount of divinylbenzene was increased to 1.5 parts.

Production Example 9

Resin I was obtained as in Production Example 5 except that the amount of divinylbenzene was increased to 3.0 parts.

Production Example 10

Resin J was obtained as in Production Example 5 except that the amount of divinylbenzene was increased to 3.3 parts.

Production Example 11

Resin K was obtained as in Production Example 5 except that the amount of divinylbenzene was increased to 3.8 parts.

Production Example 12

Resin L was obtained as in Production Example 5 except that the amount of divinylbenzene was increased to 4.0 parts.

Table 1 shows the molecular weight of the respective resin produced in the above Production Examples 1–12.

The molecular weight measured by GPC which employed commercially-available monodisperse standard polystyrene as a standard, tetrahydrofuran as a solvent and a refractometer as a detector.

TABLE 1

| Resin name | Number average molecular weight (Mn) × $10^4$ | Weight average molecular weight (Mw) × $10^4$ | Z average molecular weight (Mz) × $10^4$ | Mz/Mn |
|---|---|---|---|---|
| A | 10.1 | 25.2 | 47.7 | 4.7 |
| B | 9.5 | 20.0 | 43.5 | 4.6 |
| C | 8.2 | 18.2 | 37.5 | 4.6 |
| D | 6.0 | 13.9 | 28.3 | 4.7 |
| E | 0.4 | 0.8 | 1.8 | 4.5 |
| F | 0.5 | 1.2 | 2.8 | 5.6 |
| G | 0.6 | 1.7 | 3.6 | 6.0 |
| H | 0.7 | 2.4 | 5.3 | 7.6 |
| I | 0.9 | 4.7 | 15.2 | 16.7 |
| J | 0.9 | 5.0 | 16.0 | 17.8 |
| K | 1.0 | 5.4 | 19.2 | 19.2 |
| L | 1.1 | 6.4 | 23.0 | 20.9 |

In order to observe the effect of the Mz/Mn ratio of the Resin (Y) produced by the other production process, resins were produced in Production Examples 13–19, respectively.

Production Example 13

In the same apparatus as used in Production Example 5, 100 parts of xylol were charged. They were heated to 80° C. while introducing nitrogen. While heating at the velocity of 10° C./hr, 85 parts of styrene, 15 parts of n-butylacrylate and 5 parts of azoisobutyronitrile were continuously added to over 5 hours. After that, the polymerization of residual monomers was conducted over 10 hours. The resin solution thus obtained was subjected to solvent removal, whereby Resin M was obtained.

Production Example 14

Resin N was obtained as in Production Example 13 except that the temperature was increased to 90° C.

Production Example 15

Resin P was obtained as in Production Example 13 except that the temperature was increased to 100° C. and the heating velocity was changed to 8° C./hr.

Production Example 16

Resin Q was obtained as in Production Example 13 except that the temperature was increased to 110° C. and the heating velocity was changed to 5° C./hr.

Production Example 17

Resin R was obtained by mixing Resin E and Resin F at the ratio of 1:1.

Production Example 18

Resin S was obtained by mixing Resin E and Resin H at the ratio of 1:1.

Production Example 19

Resin T was obtained by mixing Resin E and Resin H at the ratio of 8:2.

Table 2 shows the molecular weight of the respective resin produced in the above Examples 13–19.

TABLE 2

| Resin name | Number average molecular weight (Mn) × $10^4$ | Weight average molecular weight (Mw) × $10^4$ | Z average molecular weight (Mz) × $10^4$ | Mz/Mn |
|---|---|---|---|---|
| M | 0.6 | 2.3 | 5.1 | 8.5 |
| N | 0.7 | 2.1 | 4.3 | 6.1 |
| P | 0.7 | 1.9 | 3.7 | 5.3 |
| Q | 0.8 | 1.9 | 3.4 | 4.3 |
| R | 0.4 | 1.0 | 2.6 | 6.5 |
| S | 0.5 | 1.6 | 4.8 | 9.6 |
| T | 0.4 | 1.1 | 3.7 | 9.3 |

Examples 1–4

Comparative Examples 1–4

In order to observe the effect of the Mz/Mn ratio of the second ethylene polymer Y, toner was produced by the following method using the above resins combined in accordance with Table 2.

In a Henschel mixer, 100 parts of the resin mixture, 10 parts of carbon black (MA-100: produced by Mitsubishi Kasei Corporation), 5 parts of polypropylene wax and 1 part of nigrosine dye as a charge control agent were preliminary mixed. The resultant premixture was kneaded in a twin-screw kneader at a temperature predetermined at 170° C. The mass so formed was cooled, crushed, pulverized and then classified by a classifier, whereby a toner having a particle size of 8–20 μm was produced.

Incidentally, the ratio of the resins in the table indicates the weight ratio.

The fixing property, offset resistance, image quality and the like of the thus-obtained toner were evaluated. For the evaluation of the fixing property and offset resistance, a commercially-available copying machine which had been remodeled so that the rolling temperature could optionally be changed was used.

The results are shown in Table 3.

In the table, 70% fixing temperature indicates the lowest hot roll temperature necessary for the weight residual ratio of the toner layer to exceed 70% after the toner layer of a 2 cm×2 cm solid black area on the image was rubbed fifty times by a sand eraser under a load of 125 g/cm$^2$ using a rubbing tester of the Japan Society for Promotion of Scientific Research named Gaku-shin-Shiki (manufactured by Daiei Kagaku Seiki Seisakujo).

Low-temperature offset means the temperature at which offset begins to occur when the temperature of the fixing roll is lowered.

High-temperature offset means the temperature at which offset begins to occur when the temperature of the fixing roll is raised.

The image quality was evaluated by visually judging the 50,000th copy. The results were ranked in accordance with the following standard:

A: Very clear image without fog.

B: No problems in practical use, though the image is slightly dim or has a little fogging.

C: Less legible to see because of shading-off or fogging.

D: Impossible to use because of indistinct image with severe fogging and offset.

TABLE 3

| | Ethylene polymers X | Ethylene polymers Y | Ratio X/Y | 70% Fixing temperature (°C.) | Low-temperature offset (°C.) | High-temperature offset (°C.) | Image quality |
|---|---|---|---|---|---|---|---|
| Comp. Ex. 1 | A | E | 50/50 | 170 | 140 | 210 | D |
| Comp. Ex. 2 | A | F | 50/50 | 165 | 140 | 210 | D |
| Example 1 | A | G | 50/50 | 140 | 130 | 220 | B |
| Example 2 | A | H | 50/50 | 130 | 120 | 220 | A |
| Example 3 | A | I | 50/50 | 135 | 120 | 220 | A |
| Example 4 | A | J | 50/50 | 135 | 125 | 220 | A |
| Comp. Ex. 3 | A | K | 50/50 | 150 | 145 | 220 | C |
| Comp. Ex. 4 | A | L | 50/50 | 165 | 155 | 220 | D |

Example 9

Comparative Examples 5–6

In order to observe the effect of Mw of the first ethylene polymer X used, toner was produced according to Example 1 using the above resins combined in accordance with Table 3.

Evaluation results of them are shown in Table 4, together with the results of Example 2.

TABLE 4

| | Ethylene polymers X | Ethylene polymers Y | Ratio X/Y | 70% Fixing temperature (°C.) | Low-temperature offset (°C.) | High-temperature offset (°C.) | Image quality |
|---|---|---|---|---|---|---|---|
| Example 3 | A | H | 50/50 | 130 | 120 | 220 | A |
| Example 4 | B | H | 50/50 | 130 | 120 | 215 | B |
| Comp. Ex. 5 | C | H | 50/50 | 140 | 140 | 195 | D |
| Comp. Ex. 6 | D | H | 50/50 | 150 | 155 | 180 | D |

Examples 6–9

Comparative Examples 7–10

In order to observe the effect obtained by changing the ratio of the first ethylene polymer X to the second ethylene polymer Y, toner was produced according to Example 1, using the above resins combined in accordance with Table 4.

Evaluation results of them are shown in Table 5.

TABLE 5

| | Ethylene polymers X | Ethylene polymers Y | Ratio X/Y | 70% Fixing temperature (°C.) | Low-temperature offset (°C.) | High-temperature offset (°C.) | Image quality |
|---|---|---|---|---|---|---|---|
| Comp. Ex. 7 | A | H | 15/85 | 170 | 155 | 175 | D |
| Comp. Ex. 8 | A | H | 18/82 | 150 | 150 | 190 | D |
| Example 6 | A | H | 20/80 | 130 | 130 | 210 | B |
| Example 7 | A | H | 30/70 | 125 | 125 | 220 | A |
| Example 2 | A | H | 50/50 | 130 | 120 | 220 | A |
| Example 8 | A | H | 70/30 | 130 | 125 | 220 | A |
| Example 9 | A | H | 80/20 | 130 | 135 | 220 | A |
| Comp. Ex. 9 | A | H | 82/18 | 145 | 155 | 220 | B |
| Comp. Ex. 10 | A | H | 85/15 | 165 | 175 | 220 | D |

[Note] Example 2 is the same as that in Table 3.

Examples 10–14

Comparative Examples 11–12

Using each of Resins M-T in Table 6 and Resin A in combination, toner was Produced in the manner described above and evaluated similarly.

TABLE 6

| | Ethylene polymers | | Ratio | 70% Fixing temperature | Low-temperature offset | High-temperature offset | Image quality |
|---|---|---|---|---|---|---|---|
| | Y | X | X/Y | (°C.) | (°C.) | (°C.) | |
| Example 10 | M | A | 50/50 | 140 | 130 | 220 | A |
| Example 11 | N | A | 50/50 | 145 | 130 | 220 | A |
| Comp. Ex. 11 | P | A | 50/50 | 155 | 130 | 220 | C |
| Comp. Ex. 12 | Q | A | 50/50 | 155 | 140 | 220 | D |
| Example 12 | R | A | 50/50 | 140 | 135 | 220 | B |
| Example 13 | S | A | 50/50 | 140 | 120 | 220 | A |
| Example 14 | T | A | 50/50 | 140 | 125 | 220 | A |

We claim:

1. An electrophotographic toner composition, comprising, as a principal component, a mixture of (X) 20–80 parts by weight of a first ethylene polymer having a weight-average molecular weight (Mw) of at least 200,000 and (Y) 80–20 parts by weight of a second ethylene polymer having a Z average molecular weight-/number-average molecular weight ratio (Mz/Mn) of at least 6 and a Mw of not greater than 50,000, said second ethylene polymer being obtained by subjecting an ethylenically-unsaturated monomer to solution polymerization.

2. The toner composition of claim 1, wherein the molecular weight (Mw) of the first ethylene polymer (X) falls within a range of 200,000–1,000,000.

3. The toner composition of claim 1, comprising 30–70 parts by weight of the first ethylene polymer (X) and 70-30 parts by weight of the second ethylene polymer (Y).

4. The toner composition of claim 1, wherein the ratio of Mz/Mn falls within a range of 6–100.

5. The toner composition of claim 1, wherein the Mw of the second ethylene polymer (Y) falls within a range of 1,000–50,000.

6. The toner composition of claim 1, wherein the ethylenically-unsaturated monomer is at least one monomer selected from the group consisting of acrylic esters, methacrylic esters, styrene, dialkyl fumarate esters, acrylonitrile, methacrylic acid, cinnamic acid, fumaric monoesters, acrylic acid, acrylamide and methacrylamide.

7. The toner composition of claim 1, wherein the amount of the polymer mixture in the toner falls within a range of 50–95 wt.%.

8. The toner composition of claim 1, further comprising at least one additive selected from the group consisting of polyvinyl chloride, polyolefins, polyesters, polyvinyl butyral, polyurethane, polyamide, rosin, terpene resins, phenol resins, epoxy resins, paraffin wax and polyolefin wax.

9. The toner composition of claim 1, wherein a colorant was added in an amount of 5–300 parts by weight per 100 parts by weight of the polymer.

10. The toner composition of claim 1 further comprising a charge control agent, pigment dispersant and offset inhibitor.

11. The toner composition of claim 1, wherein the polymer mixture with various additives incorporated therein is premixed, kneaded in a heated and melted state, cooled, comminuted finely, and then classified to collect particles in a range of 8–20 μm.

12. The toner composition of claim 1, wherein the second ethylene polymer is obtained by a method wherein the polymerization temperature is continuously or intermittently changed, a method in which at least two high molecular weight molecules are mixed to an extent that the Mw does not exceed 50,000, or a method in which a cross-linking agent is employed.

* * * * *

UNITED STATES PATENT AND TRADEMARK OFFICE

CERTIFICATE OF CORRECTION

PATENT NO. : 5,389,483

DATED : February 14, 1995

INVENTOR(S) : Shoji KAWASAKI, et al.

It is certified that error appears in the above-indentified patent and that said Letters Patent is hereby corrected as shown below:

On the title page, item [63], the PCT information has been omitted from the Related U.S. Application Data. It should read:

--Continuation of Ser. No. 743,371, Aug. 26, 1991, abandoned, filed as PCT/JP90/01696, Dec. 26, 1990, Signed and Sealed this Sixth Day of June, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,389,483

DATED : February 14, 1995

INVENTOR(S) : Shoji Kawasaki, et al.

It is certified that error appears in the above-indentified patent and that said Letters Patent is hereby corrected as shown below:

On the title page, item [63], the PCT information has been omitted from the Related U.S. Application Data. It should read:

--Continuation of Ser. No. 743,371, Aug. 26, 1991, abandoned, which was the national stage of international application number PCT/JP90/01696, Dec. 26, 1990.--.

Signed and Sealed this

Eleventh Day of July, 1995

*Attest:*

Bruce Lehman

BRUCE LEHMAN

*Attesting Officer*

*Commissioner of Patents and Trademarks*